US005311226A

United States Patent [19]

Karasawa

[11] Patent Number: 5,311,226

[45] Date of Patent: May 10, 1994

[54] TOY PROJECTOR

[75] Inventor: Hideyasu Karasawa, Nagareyama, Japan

[73] Assignee: Sente Creations Co., Ltd., Tokyo, Japan

[21] Appl. No.: 939,120

[22] Filed: Sep. 2, 1992

[30] Foreign Application Priority Data

Sep. 4, 1991 [JP] Japan ..... 3-70865[U]

[51] Int. Cl.[5] ..... G03B 21/26

[52] U.S. Cl. ..... 353/30; 353/37; 353/34; 353/49

[58] Field of Search ..... 353/34, 30, 48, 49, 353/50, 82, 94, DIG. 3, 62, 32, 35, 37, 83, 7, 10, 122; 446/485, 484; 40/442, 443, 451, 448; 434/287

[56] References Cited

U.S. PATENT DOCUMENTS

| | | | |
|---|---|---|---|
| 1,024,734 | 4/1912 | Massohn et al. | 353/34 |
| 1,461,133 | 7/1923 | Marten | 353/82 |
| 1,857,135 | 5/1932 | Brenkert et al. | 353/34 |
| 3,043,190 | 7/1962 | Mandler | 353/82 |
| 4,645,319 | 2/1987 | Fekete | 353/37 |

FOREIGN PATENT DOCUMENTS

| | | | |
|---|---|---|---|
| 533765 | 9/1931 | Fed. Rep. of Germany . | |
| 3803486 | 8/1988 | Fed. Rep. of Germany | 353/82 |
| 1340261 | 9/1963 | France . | |

*Primary Examiner*—William A. Cuchlinski, Jr.
*Assistant Examiner*—William C. Dowling
*Attorney, Agent, or Firm*—Salter, Michaelson & Benson

[57] ABSTRACT

A toy projector (10) is equipped with a light source (11), a non-light-transmitting member (13) having at least one light-transmitting part (14) which transmits the light from the light source (11), a member (15) having light-transmitting designs provided in a direction other than the direction in which the light-transmitting portion (14) has been placed with respect to the light source (11), a mirror (19) reflecting the said design, and a lens (17) arranged between the said mirror (19) and the member (15) having the said design. The light from the said at least one light-transmitting part (14) and the design reflected by the said mirror (19) are projected on to the same surface.

9 Claims, 5 Drawing Sheets

TOY PROJECTOR

FIELD OF THE INVENTION

The present design relates to a toy projector.

DESCRIPTION OF THE PRIOR ART

An illumination unit for a toy has already been developed, which unit is arranged in such a way that, by means of a light source provided within a dome body which rotates in linked drive with a drive mechanism, the whole of the dome body shines and a pattern rises up in the surroundings, and the pattern is projected on to the ceiling or walls via a transparent patterned portion in the dome body (Japanese Laid-open Utility Model H 1-112898). Since the entire dome body shines in this toy, exactly because of its brightness, the pattern projected on to the ceiling and walls is indistinct.

Further, a musical box is also known in which the music box container incorporates a light source and a rotatable light-transmitting plate rotating in linked movement with a drum with pins attached, and which can project figures depicted on the light-transmitting rotatable plate on to the wall by means of a mirror provided in the lid (Japanese Laid-open Utility Model H 3-75799). With this music box, the projected figures are also small and the outline is also unclear since the figures are reflected by the mirror provided inside the lid.

SUMMARY OF THE INVENTION

In accordance with the present invention, a toy projector comprises light source means, a first light-transmitting member through which the light from the light source means passes along a first path, a second light-transmitting member having a light-transmitting design through which light from the light source means passes along a second path; and focussing means for focussing light passing along the second path, the arrangement being such that light passing through the first light-transmitting member and the design is projected on to substantially the same surface.

The present invention provides a toy projector which clearly projects designs which draw a child's interest, such as animals, flowers, picture-book and animated cartoon characters, monsters, ghosts, space ships and UFO'S, against a background of, for example, constellations projected here and there over a projection surface such as a pitch-black ceiling or screen.

Preferably, the projector further comprises a mirror which reflects light passing through the design, the focusing means being arranged between the mirror and the member having the design. In this case the projector is preferably equipped with a means for changing the direction of the above mirror surface.

A preferred example of the toy projector of the present design is characterised in that it is equipped with several of the abovementioned members having different designs and a means for switching the design reflected by the mirror.

The toy projector of the present design may be equipped with a plurality of groups of members having a light-transmitting design as described above, mirrors reflecting the said design, and focusing means arranged between the said mirrors and the members having a design.

In the toy projector of the present design, the light source means is preferably common to both light paths although separate light sources could be used.

In one example a figure corresponding to the colour and shape of the first light-transmitting member is projected onto the pitch black ceiling or walls. The outline of the projected image is somewhat indistinct since the image is from a point light source. The light passing through the light-transmitting design passes through the focusing means and, preferably, is reflected by a mirror before being projected on to the ceiling or wall, and the projected design is therefore a distinct image with a clear outline. Consequently, the somewhat indistinct image and the focused well-defined image are projected on to the same surface.

The toy projector of the present design has advantages in that distinct images of designs which draw a child's interest are projected against a background of fantastic images from a point light source with, so that it is pleasurable to look at, useful for cultivating the senses and nor does the child feel lonely as he sees the images which appear on the ceiling or wall with music so that he develops the habit of sleeping alone.

An example of a toy projector according to the invention will now be described with reference to the accompanying drawings, in which:

DETAILED DESCRIPTION OF THE EMBODIMENTS

Figure 1:
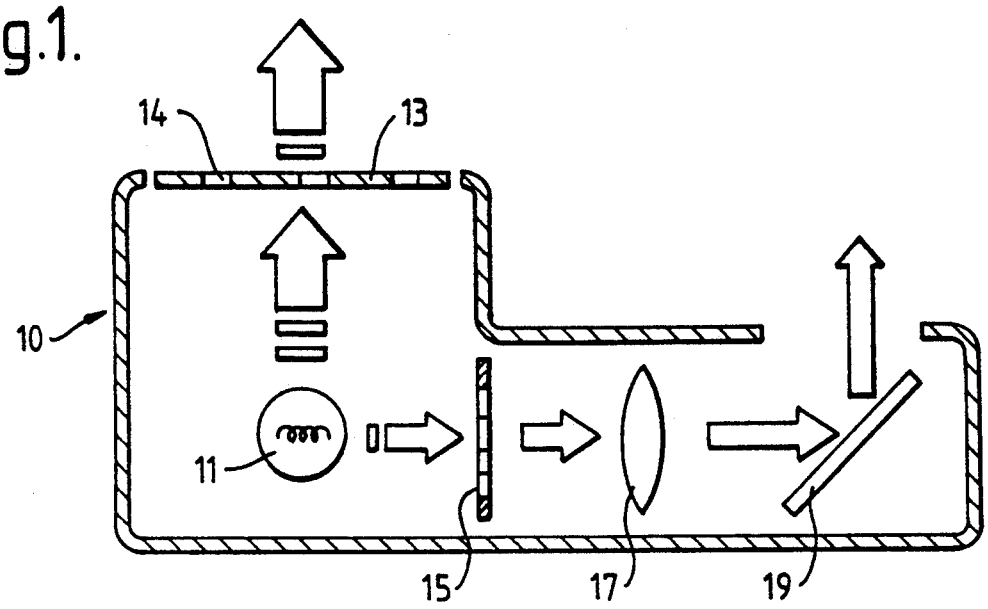
FIG. 1 is an outline cross-section showing the basic structure of the toy projector of the present design.

FIG. 1 is an outline drawing showing the basic structure of the toy projector of the present design.

A light source 11 is provided within the toy projector 10, and the light from the light source 11 is projected on to a projection surface (not shown) outside the toy 10 having passed through a light-transmitting part 14 provided in part 13 of the non-light-transmitting housing or a non-light-transmitting member, such as a member coloured black, dark blue or dark brown, for example a film, sheet, glass plate or synthetic resin plate. The light-transmitting part may be a circle,, an angled shape, a crescent, a star, a design of some type or any other desired shape, and the colour can also be selected as desired.

A colourless or coloured member having a light-transmitting design, for example a film, sheet, glass plate or synthetic resin plate 15 is provided in a direction other than the direction in which the light-transmitting part 14 has been positioned with respect to the light source 11, and the light which has passed through the design passes through a focusing means 17, such as a convex lens or a Fresnel lens, is reflected by a mirror 19 placed in its path and is projected on to the projection surface outside the toy 10. The arrow represents the direction in which the light proceeds. The projected image will typically overlie the image from the part 14.

In this way, an unfocused image and a distinct focused image are simultaneously projected on to a projection surface such as a ceiling or wall.

Figure 2:
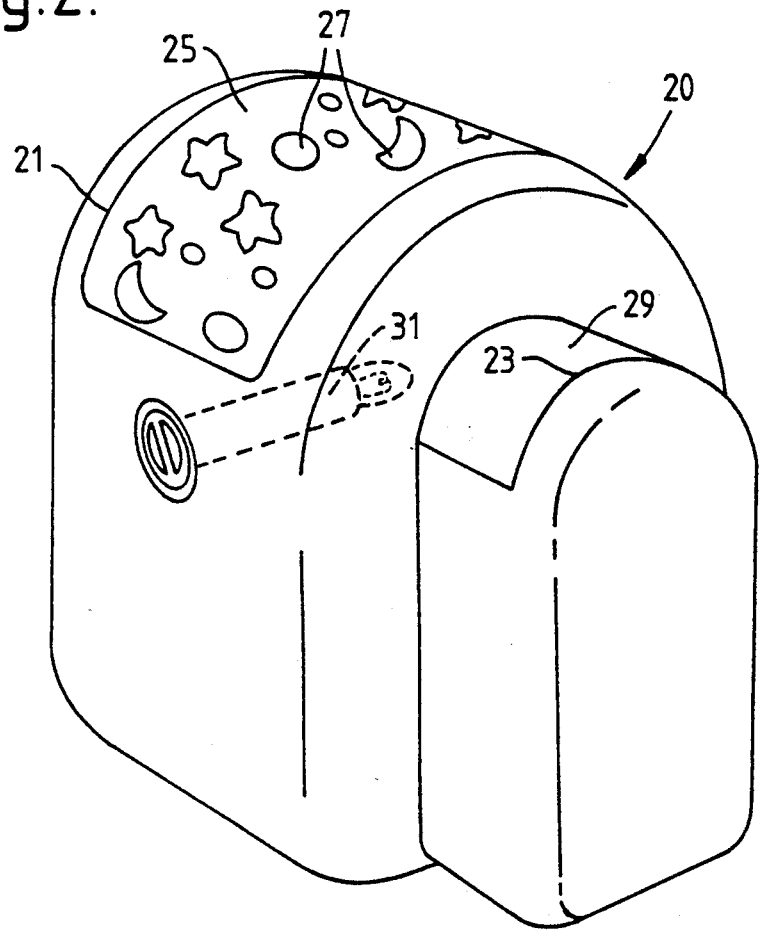
FIG. 2 is an isometric front view showing an embodiment of the toy projector.
Figure 3:
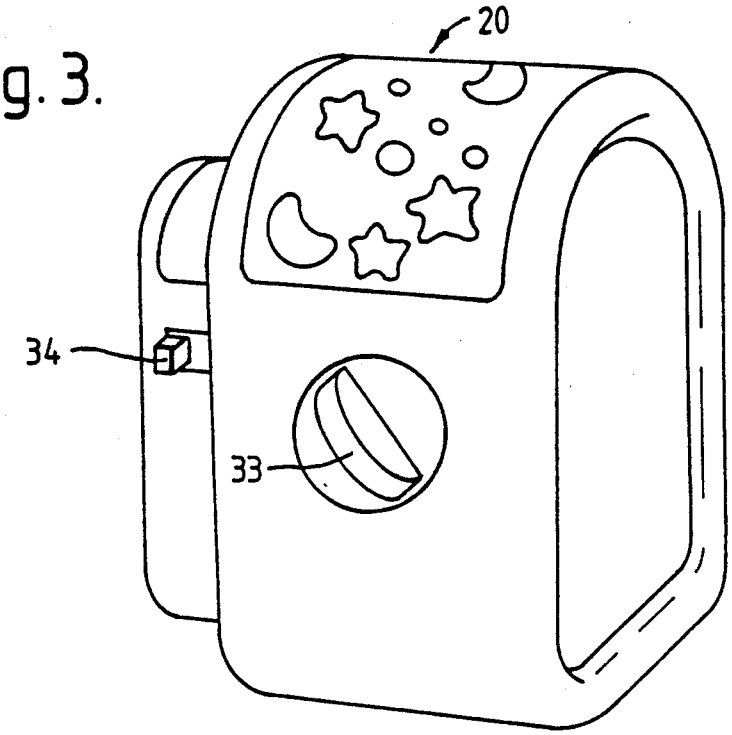
FIG. 3 is an isometric rear view of the embodiment shown in FIG. 2.

FIG. 2 is an isometric front view and FIG. 3 is an isometric rear view showing one embodiment of the toy projector of the present design.

The semi-circular top surface of the housing of the toy projector 20 has two windows 21 and 23, large and small. The large window 21 is covered with a film having coloured or colourless light-transmitting FIGS. 27, such as stars, moons and circles in a black non-light-transmitting base 25, and the small window is covered with a colourless transparent sheet 29. The light source unit 31 is inserted inside the housing from outside the housing. A handle 33 and focusing grip 34 are provided projecting from the outside surface of the housing.

FIG. 4 to FIG. 8 are explanatory drawings of the mechanism on the inside of the housing of the toy projector 20.

Figure 4:
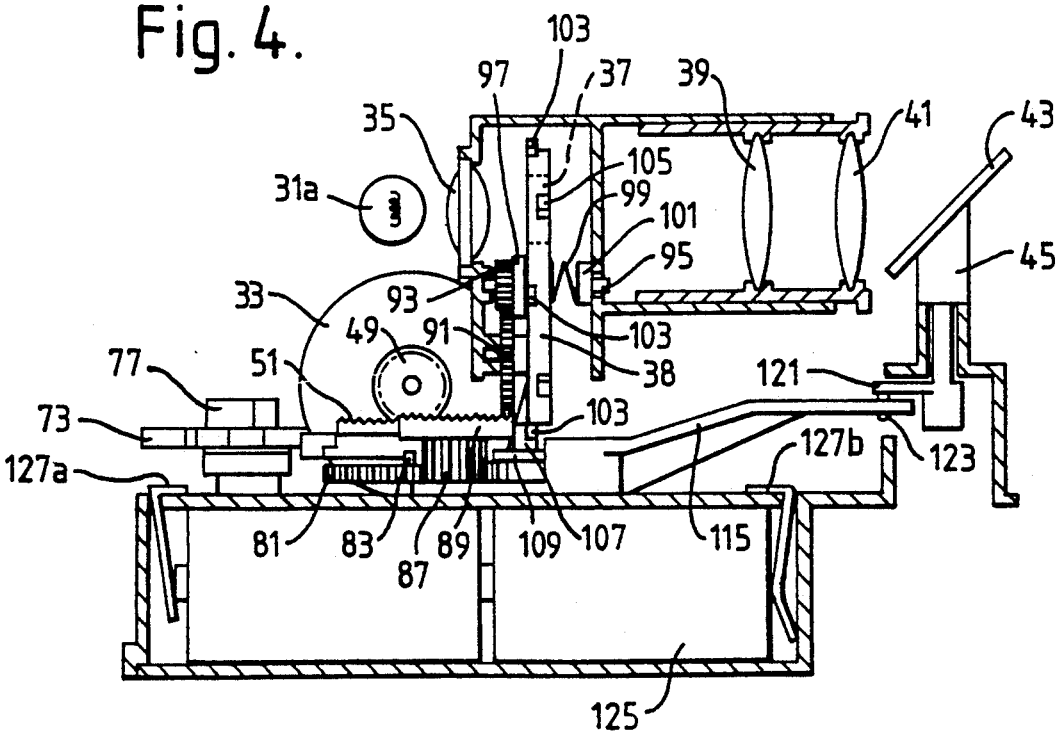
FIG. 4 is a cross-section showing the main composition of the inside of the housing of the embodiment.

FIG. 4 shows the mechanism as seen from the front. In FIG. 4, the bearing, frame and support formed integrally with the housing are shown in cross-section using oblique lines.

Figure 5:
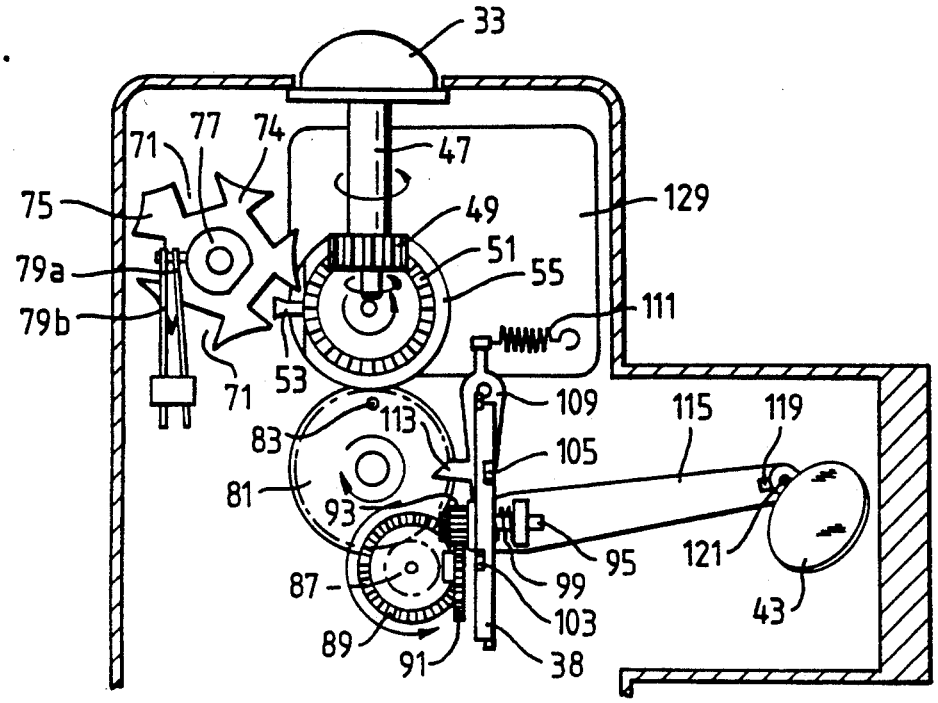
FIG. 5 illustrates the gear train in more detail.

FIG. 5 is a plan view of the main mechanism seen from above omitting the lens portions.

A condensing lens 35 is provided to the side of the light source 31*a*, and a design 37, two convex lenses 39 and 41 and a mirror 43 are successively provided on the optical path.

Figure 7:
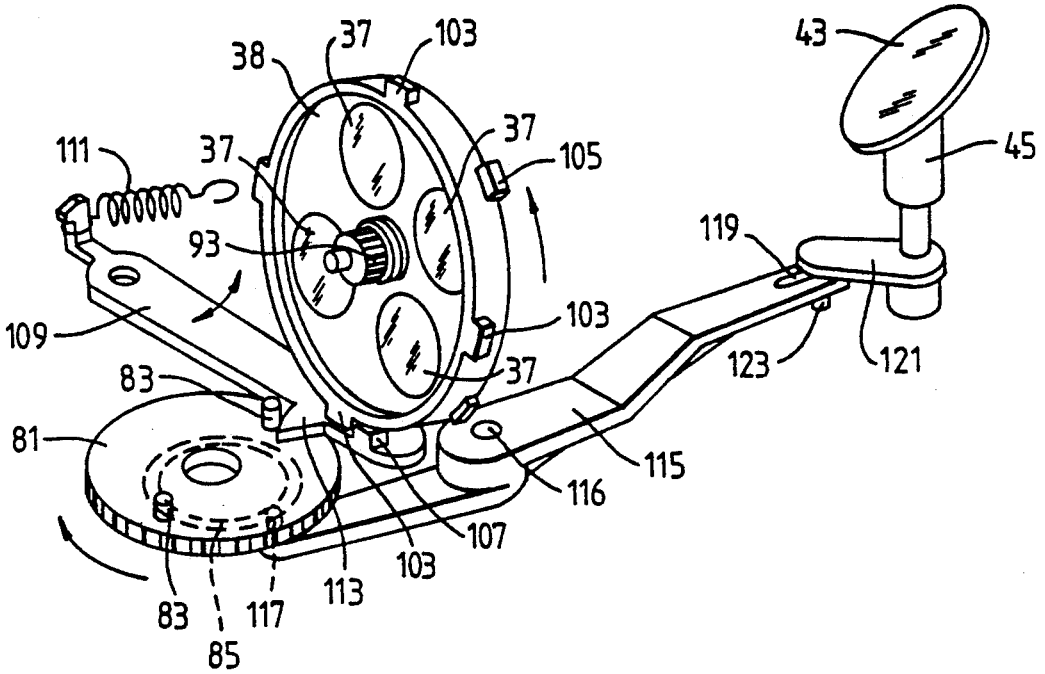
FIG. 7 illustrates the switching mechanism and the mirror-swinging mechanism.
Figure 8:
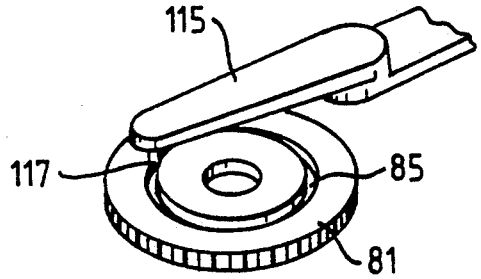
FIG. 8 illustrates the gear wheel portion in FIG. 7 depicted from the underside.

As shown in FIG. 7, for the design 37, four sheets with different designs 37 are inserted in a disc 38, and one of the designs is positioned in the optical path of the light which has passed through the condensing lens 35.

The two convex lenses 39 and 41 constitute the focusing means, the positions of which can be adjusted by moving the focusing grip 34 in order to focus.

Further, the mirror 43 is fitted in such a way that the mirror surface faces upwards at a previously determined angle on the shaft 45, and the shaft 45 is supported so as to be able to rotate freely. The light reflected by the mirror 43 is projected on to a projection surface outside the toy 20 having passed through the colourless transparent sheet 29 of the small window 23.

A gear train is provided within the housing of the toy projector 20 in a position so as not to block the optical path of the light source 31*a* upwards or laterally, consisting of a switch mechanism for the light source, a music-box mechanism which plays music at the same time as the light is lit, a mechanism which switches designs by rotating the disk, and a mechanism which moves the position in which the design is projected by rotating the shaft of the mirror 43 in a range of about 100°. To elaborate, a gear wheel 49 is fixed axially on the shaft 47 of the handle 33 projecting from the side of the housing, and this gear wheel 49 meshes with a crown gear 51.

Figure 6:
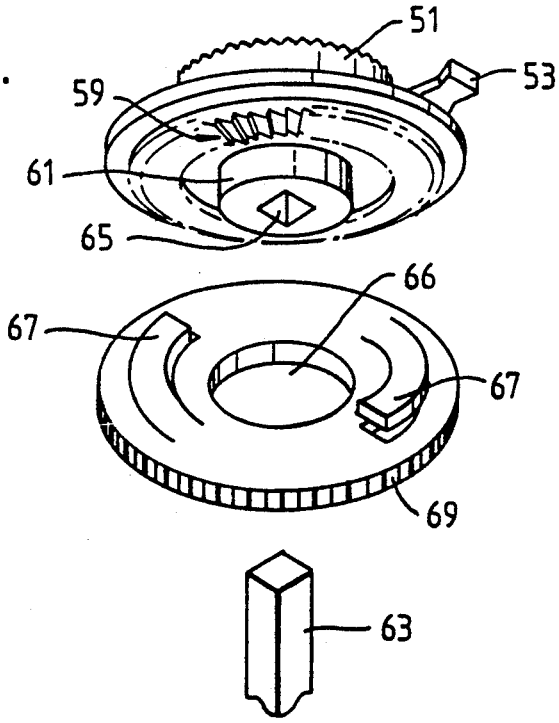
FIG. 6 is a drawing showing the relationship between the gear unit and the gear wheel with which it meshes.

FIG. 6 is a drawing explaining the make-up of the unit of the crown gear 51.

As shown in FIG. 5 and FIG. 6, the crown gear 51 is formed as an integral unit with a disc 55 having a projecting part 53 on its circumferential surface, a toothed ring 59 having a clutch function provided on the under surface thereof, and a cylindrical shaft part 61 projecting from the under surface; and a shaft hole 65, into which an angled shaft 63 fits, is provided in the shaft part 61.

As the handle 33 is turned by hand clockwise and the shaft 63 rotates clockwise, the spiral spring (not depicted) of the music box, which is the source driving the rotation of the gear train, is wound up; and the shaft 63 rotates anticlockwise when the spiral spring unwinds under the restoring force.

As shown in FIG. 6, a gear wheel 69 having in its centre a shaft hole 66 which encircles the abovementioned cylindrical shaft part 61 with freedom of rotation and having in its upper surface two projections 67 which have a clutch function is provided below the abovementioned unit with the crown gear 51; and the gear wheel 69 rotates in an anticlockwise direction, the projections 67 only meshing with the abovementioned toothed ring 59 when in anti-clockwise rotation, which is to say when the spiral spring unwinds.

A rotating plate 73 having a plurality (five in the figure) of cut-away portions 71 which mesh with the projecting part 53 of the disc 55 is pivotally supported with freedom of rotation to the side of the abovementioned unit with the crown gear 51. The projecting parts 74 defined by each of the cut-away portions 71 have a shape which does not obstruct the rotation of the disc 55, although one projecting portion 75 alone has a shape which does obstruct the rotation of the disc 55 when the projecting part 53 meshes with the cut-away portion 71 at its front in the direction of rotation. Therefore, with the rotating plate 73 depicted, the unit with the crown gear 51 is prevented from rotating at every fifth rotation of the crown gear 51 when the spiral spring is wound up by turning the handle by hand or when the spiral spring unwinds.

The rotating plate 73 is formed integrally with a partially cut disc 77 which rotates coaxially, and one terminal 79*a* of the switch for the light source 31*a* makes contact with the circumferential surface of the disc 77. When the terminal 79*a* comes into contact with the arc portion of the disc 77, the terminal 79*a* is pushed and touches another terminal 79*b* to allow an electric current to pass and the 'light source 31*a* is lit, while, when the terminal 79*a* comes into contact with the chord portion of the disc 77, the terminal 79*a* is separated from the terminal 79*b* and the light is extinguished. This extinguishing of the light is set so as to be effected simultaneously with the stopping of the crown gear 51 when it has rotated five time's anticlockwise, due to the restoring force of the spiral spring.

The gear wheel 69, which rotates anticlockwise only when the spiral spring unwinds as described above, meshes with a gear wheel 81. The gear wheel 81 has the same number of teeth as the gear wheel 69, on its upper surface it has two corresponding projections 83 formed on a diametral line, and on its under surface it has a circular recessed portion 85 formed with a different centre (FIG. 7).

FIG. 7 is a drawing explaining the switching mechanism for the image 37 and the swing mechanism for the mirror 43.

The gear wheel 81 meshes with a gear wheel 87. The gear wheel 87 is integrally formed with a crown gear 89 which rotates about the same axis. The crown gear 89 meshes with a gear wheel 91, and the gear wheel 91 meshes with a gear wheel 93.

The gear wheel 93 is mounted on a shaft 95. The shaft 95 is provided in sequence with the gear wheel 93, a swing disc 97, a disc 38 having designs 37, a coil spring 99, and a disc 101. The shaft 95 always rotates as one body with the gear wheel 93, but the swing disc 97, the disk 38 having the designs 37, the coil spring 99 and the disc 101 are supported on the shaft with freedom of rotation so that the disk 38 having the designs 37 is prevented from rotating when subjected to a restraining force under the cam action of the coil spring 99.

Four projections 103 and four projections 105 are alternately and equidistantly provided on the light-source side and the mirror side respectively of the outer circumferential surface of the disk 38 having the designs 37. Below disc 38 is located a lever 109 which has at its end on the upper surface a holding projection 107 which latches with the projections 103 on the light-source side when a said projection 103 arrives at the very bottom.

The lever 109 is urged towards the light-source side by a spring 111. On its side surface, this lever 109 has a projecting part 113 which makes contact with the projections 83 on the upper surface of the gear wheel 81. The end of the projecting part 113 is formed so as to be longer in the direction of rotation of the gear wheel 81 so that the lever 109 is pushed outwards when the gear wheel 81 rotates. As a result, the holding projection 107 at the end of the lever 109 is displaced beyond the positions of the projections 103 and 105 on both sides of the circumference of the disc 38 having designs 37, the holding operation of the holding projection 107 is released, and the disc 38 rotates with the shaft 95 while the design 37 is switched to the following design 37.

The lever 109 attempts to return under the restoring force of the spring 111. If the disc 38 rotates quickly and the lever 109 returns slowly, the holding projection 107 first latches on to a projection 105 on the mirror side and then latches on to a projection 103 on the light-source side. When it returns quickly, it latches directly on to a projection 103 on the light-source side. This is to say, the projections 105 on the mirror side are provided in order to ensure the latching of the holding projection 107 with the projections 103 when the lever 109 returns slowly.

When the gear wheel 81 has made half a rotation, the following projection 83 pushes the projecting part 113 of the lever 109 outwards and the disc 38 rotates again. This rotation again switches the design 37.

A projection 117 provided on the upper surface at the end of a long, thin connecting member 115 fits into the recessed portion 85 on the under surface of the above-mentioned gear wheel 81. An elongated hole 119 is provided at the other end of the connection member, and into this is fitted a projection 123 provided on the under surface at the end of the pivoting member 121 which pivots integrally with the shaft 45 of the mirror 43. The connecting member 115 pivots around the shaft 116.

When the gear wheel 81 rotates, the projection 117 of the connecting member 115, which fits into the recessed portion 84 on the under surface of the said gear wheel 81, tracks along the recessed portion 84, and this movement is transmitted to the projection 123 of the pivoting member 121 fitted into the elongated hole 119 at the other end of the connecting member 115. Thus, in one rotation of the gear wheel 81, the pivoting member 121 pivots approximately 100° and returns to its origin. The mirror 43 therefore also swings approximately 100°.

The design is such that the disc 38 is stopped and one design 37 is projected so that the image moves over the projection surface while the mirror 43 is swinging approximately 100°, and the disc 38 rotates 450 and the following design 37 is positioned in the optical path while the mirror 43 is returning to its origin.

As shown in FIG. 4, the batteries 125, which are the power source for the light source 31*a*, are kept in the bottom of the housing in such a way as to allow them to be replaced, and the contacts 127*a* and 127*b* are respectively connected to the terminals 79*a* and 79*b* via the contacts of the light-source unit.

As shown in FIG. 5, a music box unit is kept in a case 129, and the music is played when the lamp is turned on and the music is stopped at roughly the same time as the lamp is turned off as a result of the switch mechanism of the light source 31*a* and the action of the gear train of the spiral spring of the music box mentioned above acting as the drive source.

Figure 9:
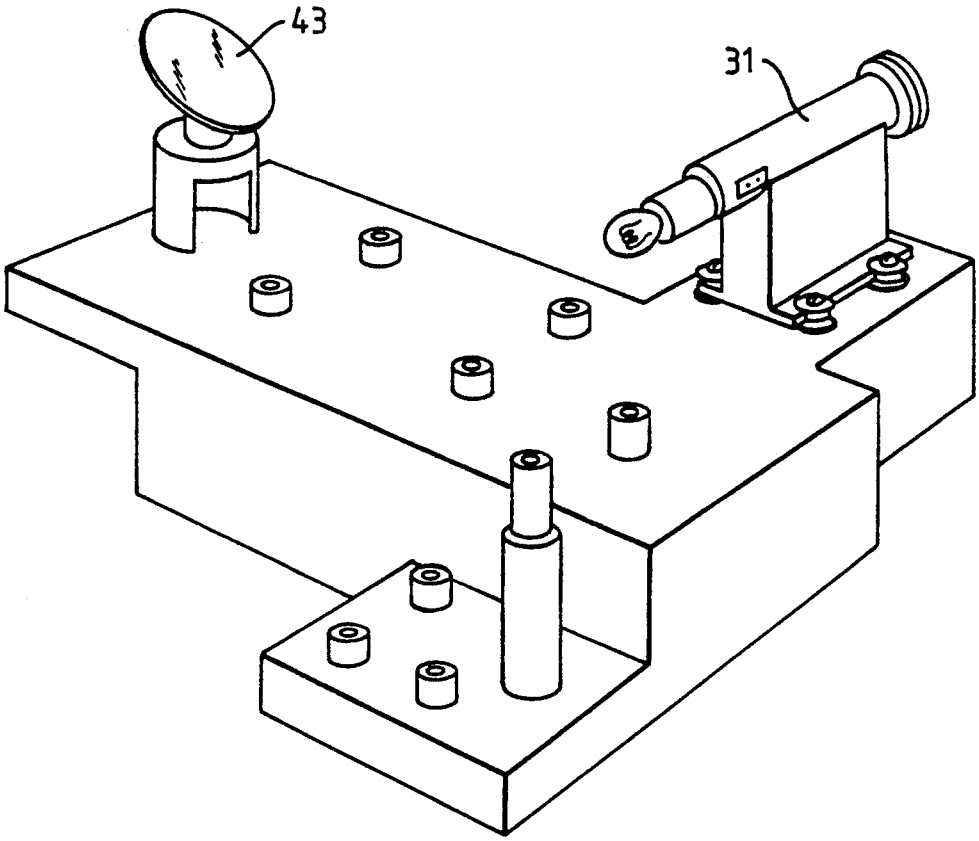
FIG. 9 illustrates the light source unit and mirror.

FIG. 9 represents the arrangement within the housing of the light-source unit 31. The light-source unit 31 can be replaced when the light bulb has blown.

As described above, with the toy projector 20, an image constituting a widely spread and slightly indistinct background and an image with a clear and distinct design are projected, together with the tune from the music box, through the drive force of the spiral spring of the music box, stored when the handle 33 is wound up; and the image with a distinct design moves through the image constituting the background, this design suddenly disappears and another design shortly appears and moves through the image constituting the background. In this way, images with interesting designs successively appear and disappear in an image constituting a pitch-black and fantastic background, leading the viewer into a fantasy world.

The present design was explained above with reference to an embodiment, but its scope is not limited to the embodiment described above, and various design modifications, new mechanism additions and the like are included in the scope of the present design provided that they do not exceed the purport of the present design.

By way of example, the non-light-transmitting member need not be formed as a separate member and at least one light-transmitting part may be provided in the housing body, and the intensity of the projected light may be partially changed by providing a semitransparent portion.

In the embodiment, a single light source has been given the role of a point light source transmitted through the light-transmitting portion constituting the background and the role of the light source for the image with a focused design, but the light source is not limited to one unit, and the roles may be allocated using a plurality of light sources. Further, images of a-plurality of focused designs may be projected in an image from a point light source constituting the background by using a plurality of groups of members having light-transmitting designs, focusing means and mirrors.

In the embodiment, the image of the design was made brighter by condensing the light using a condensing lens, but the design can be projected distinctly if it is equipped with a focusing means.

Further, the mirror angle changing means and design-switching means may be adjusted and switched by hand from outside the housing and not automatically by gear wheels. Further, the design sheet may be freely replaced from the outside. A motor may be used as the drive source for the gear train.

We claim:

1. A toy projector comprising:

light source means;

a first light-transmitting member having a first light-transmitting design through which light from the light source passes along a first path so as to form a first projection on a projection surface, a second light-transmitting member having a second light-transmitting design through which light from the light source passes along a second path;

a movable mirror onto which light passing along said second path impinges, said light reflecting off said mirror so as to form a second projection on said projection surface;

focussing means for focussing light passing along said second path; and drive means for causing reciprocating movement of said mirror along a predetermined path so that said second projection is moved relative to said first projection on said projection surface.

2. A toy projector according to claim 1, wherein the focussing means is arranged between the mirror and the second light-transmitting member.

3. In the toy projector of claim 1, said second light-transmitting member including a plurality of different designs, said drive means being further operative for causing step-wise movement of said plurality of designs into the second light path.

4. In the toy projector of claim 1, said predetermined path comprising an arc.

5. In the toy projector of claim 4, said arc comprising about one hundred degrees.

6. In the toy projector of claim 3, said mirror being movable from a first position to a second position along said predetermined path, said drive means moving said mirror means from said first position to said second position after a step-wise movement of one of said designs, said drive means moving said mirror from said second position back to said first position during a step-wise movement of one of said designs.

7. In the toy projector of claim 1, said first and second projections substantially overlapping on said projection surface.

8. A toy projector comprising:

a light source;

a first light-transmitting member having a first light-transmitting design through which light from said light source passes along a first path so as to form a first projection on a projection surface, a second light-transmitting member having a plurality of light-transmitting designs, said light from said light source passing through a selected one of said designs along a second path;

a movable mirror onto which light passing along said second path impinges, said light reflecting off said mirror so as to form a second projection on said projection surface;

focussing means arranged between said second light-transmitting member and said mirror for focusing light passing through said second light-transmitting member onto said mirror; and drive means for causing step-wise movement of said second light transmitting member wherein a different one of said plurality of designs is moved into said second light path at each step, said drive means further being operative for causing reciprocating movement of said mirror along a predetermined path so that said second projection is moved relative to said first projection on said projection surface.

9. In the toy projector of claim 8, said first and second projections substantially overlapping on said projection surface.

* * * * *